US007499559B2

(12) United States Patent
Wyrsch

(10) Patent No.: US 7,499,559 B2
(45) Date of Patent: Mar. 3, 2009

(54) HEARING DEVICE AND METHOD FOR CHOOSING A PROGRAM IN A MULTI PROGRAM HEARING DEVICE

(75) Inventor: Sigi Wyrsch, Berne (CH)

(73) Assignee: Bernafon AG, Berne (CH)

( * ) Notice: Subject to any disclaimer, the term of this patent is extended or adjusted under 35 U.S.C. 154(b) by 567 days.

(21) Appl. No.: 10/539,779

(22) PCT Filed: Dec. 9, 2003

(86) PCT No.: PCT/IB03/06356

§ 371 (c)(1),
(2), (4) Date: Sep. 7, 2005

(87) PCT Pub. No.: WO2004/056154

PCT Pub. Date: Jul. 1, 2004

(65) Prior Publication Data

US 2006/0215860 A1 Sep. 28, 2006

(30) Foreign Application Priority Data

Dec. 18, 2002 (DK) ..... 2002 01930

(51) Int. Cl.
*H04R 25/00* (2006.01)

(52) U.S. Cl. ..... 381/314; 381/312

(58) Field of Classification Search ..... 381/312, 381/314, 317, 320, 321, 323, 60, 104, 107; 713/400

See application file for complete search history.

(56) References Cited

U.S. PATENT DOCUMENTS

| | | | | | |
|---|---|---|---|---|---|
| 4,425,481 | A | * | 1/1984 | Mansgold et al. | 381/317 |
| 4,989,251 | A | * | 1/1991 | Mangold | 381/314 |
| 5,581,747 | A | * | 12/1996 | Anderson | 713/400 |
| 5,604,812 | A | | 2/1997 | Meyer | |
| 5,706,351 | A | | 1/1998 | Weinfurtner | |
| 6,035,050 | A | | 3/2000 | Weinfurtner | |
| 2002/0037087 | A1 | | 3/2002 | Allegro et al. | |

FOREIGN PATENT DOCUMENTS

| | | |
|---|---|---|
| DE | 10142347 | 10/2002 |
| WO | 0176321 | 10/2001 |

* cited by examiner

*Primary Examiner*—Huyen D Le
(74) *Attorney, Agent, or Firm*—Dykema Gossett PLLC

(57) ABSTRACT

The invention concerns a hearing device having an input transducer and an output transducer with a signal path therebetween, signal processing means connected in said signal path for influencing a signal in the signal path dependent on a PPS (processing parameter set), and a PPS memory accessible by the signal processor means for storing a number of different PPS's for use by the signal processing means. The system has means for monitoring the acoustic environment in a learning mode, where the user chooses the PPS to be used in the signal processing. Later in an automatic mode the hearing aid system chooses the PPS based on a comparison of the current acoustic environment with the monitored environment in the learning phase.

16 Claims, 5 Drawing Sheets

Learning mode: Number of CAV: 18, Buffer length 16

| | 1 | 2 | 3 | | 16 | Number of 1's | Stored value | Weight |
|---|---|---|---|---|---|---|---|---|
| CAV 1 | 1 | 0 | 0 | | 1 | 11 | 1 | High |
| CAV 2 | 0 | 1 | 1 | | 0 | 8 | 0 | Low |
| CAV 3 | 1 | 1 | 1 | | 1 | 14 | 1 | High |
| | | | | | | | | |
| CAV 18 | 0 | 0 | 0 | | 0 | 1 | 0 | High |

Fig. 4

Learning mode, Storing CAV values

| | 1 | 2 | 3 | 4 | 5 | Number of 1's | **CAV value** |
|---|---|---|---|---|---|---|---|
| Ac. 1 | 1 | 1 | 0 | 1 | 1 | 4 | **1** |
| Ac. 2 | 0 | 0 | 1 | 0 | 1 | 2 | **0** |
| Ac. 3 | 1 | 0 | 0 | 0 | 0 | 1 | **0** |
| Ac. 4 | 0 | 0 | 1 | 1 | 0 | 2 | **0** |
| | | | | | | | |
| Ac. 18 | 0 | 1 | 1 | 1 | 1 | 4 | **1** |

Fig. 5

Automatic mode, Calculating CAV values

| | 1 | 2 | 3 | | 9 | Number of 1's | CAV value |
|---|---|---|---|---|---|---|---|
| Ac. 1 | 1 | 1 | 1 | | 0 | 8 | 1 |
| Ac. 2 | 0 | 0 | 0 | | 1 | 3 | 0 |
| Ac. 3 | 1 | 1 | 0 | | 1 | 5 | 1 |
| Ac. 4 | 1 | 1 | 1 | | 1 | 6 | 1 |
| | | | | | | | |
| Ac. 18 | 1 | 0 | 0 | | 0 | 1 | 0 |

Fig. 6

| | **Stored CAV values** | Stored value manual mode PPS 1 | Stored value manual mode PPS 2 | Stored value manual mode PPS 3 |
|---|---|---|---|---|
| CAV 1 | **1** | 1 | 1 | 1 |
| CAV 2 | **0** | 0 | 1 | 0 |
| CAV 3 | **1** | 0 | 0 | 1 |
| CAV 4 | **1** | 0 | 1 | 1 |
| | | | | |
| CAV 18 | **0** | 1 | 1 | 0 |
| Score | | 2 | 5 | 15 |

Fig. 7

HEARING DEVICE AND METHOD FOR CHOOSING A PROGRAM IN A MULTI PROGRAM HEARING DEVICE

AREA OF THE INVENTION

The invention is directed to programmable hearing aid systems wherein a number of different programs are provided and among which the user of the hearing aid can choose in order to use the program best suited to the actual acoustic environment. The invention is useable in connection with both in the ear and behind the ear hearing aids as well as implantable devices with electrical or mechanical stimulation of inner ear part.

BACKGROUND OF THE INVENTION

The act of choosing a program can be done discretely by the use of a remote control, or less discretely by touching buttons placed on the hearing aid. In either case however the user is made aware of his hearing disability and in some degree also people around may notice this action. Further this action may take some time, and during this time the attention of the hearing aid user is directed to the hearing aid and not directly at the surroundings, and these moments of less attention is disturbing to both the hearing aid user and to the people who are maintaining a conversation or other kind of communication with him or her.

From U.S. Pat. No. 6,035,050 a hearing aid system is known, wherein a solution to the above problem is attempted. The hearing aid system has a matching arrangement with a first memory for several parameter sets available for selection for each of several hearing situations, an input unit for selecting a current hearing situation and for selecting one of the several parameter sets available for this hearing situation, and a second memory for allocation data that identify the parameter sets selected for each hearing situation. For the determination of an optimal parameter set for each of several hearing situations, an optimal user-specific parameter set is allocated to each hearing situation as it arises during an optimization phase. After the optimization phase, the allocation data are evaluated in order to determine an optimal parameter set for each hearing situation. This parameter set is then programmed as the parameter set which will be called to set the transmission characteristics of the hearing aid whenever the hearing situation allocated thereto occurs.

According to the teachings of U.S. Pat. No. 6,035,050 the user needs to select both a hearing situation, which he believes to be in and make a choice as to the processing parameter set, which provides the best performance in the given situation. This leaves the user with many complex choices during the optimization phase, and the risk of confusion is high. Further this prior art hearing aid system prescribes the use of both an auxiliary module and a control module.

SUMMARY OF THE INVENTION

The object of the invention is to provide a hearing aid system with a learning capacity, which is easy and straightforward to use and where the training can be carried out without the use of any special devices apart from the hearing aid and possibly a remote control.

This is achieved according to the invention with a hearing device comprising:

a programmable hearing aid having an input transducer and an output transducer with a signal path therebetween, and a signal processing means connected in said signal path for influencing a signal in the signal path dependent on a Processing Parameter Set (hereafter named PPS), and a PPS memory accessible by the signal processor means for storing a number of different PPS's for use by the signal processing means, user input means for the user to choose a specific PPS to be used by the signal processing means in a manual mode whenever the user experiences a specific acoustic environment, means for storing in a second memory of Characterizing Acoustic Values (hereafter named CAV) derived from the signal during use of each of the user chosen PPS during a learning period in the manual mode, means for capturing and temporarily storing in a first memory of current CAV in an automatic mode, means for automatic selection of a PPS in an automatic mode, whereby the selection is based on the comparison between current CAV's stored in the first memory and CAV's stored in the second memory.

In the following a distinction is made between an acoustic value, and a Characterizing Acoustic Value (CAV), where an acoustic value as the value at one specific point in time of an acoustic parameter, whereas the CAV is determined on the basis of several acoustic values which are logged during a period of time.

Each of the PPS's or processing parameter sets are similar to a program, and in the learning period the user only has to find out which of a number of PPS possibilities gives the best or preferred sound. The possible choices of PPS's are preferably programmed into the hearing aid by the hearing aid acoustician based on the users expected needs and lifestyle. Once a PPS is chosen in a given sound environment the hearing aid system starts to record and store the CAV's or characterizing acoustic values of that environment. During the learning period all possible PPS's should be activated in order for the hearing aid system to store sufficient data or CAV's for the acoustic environment in which the user chooses to activate the respective PPS. Once the learning period is over the automatic mode is activated, and now the current CAV's are continually calculated and compared with the stored CAV's. The best match between current and stored CAV's form the basis of an automatic choice of PPS. When using the hearing aid the user only has to choose program or PPS's during the learning period, and he does not have to worry about the sound environment. In the automatic mode the hearing aid is capable of choosing the program or PPS which matches the choices made during the training period.

In an embodiment of the invention the CAV's are derived from one or more of the following acoustic values (which could also be internal hearing instrument parameters):

signal level in 3 or more bands, modulation index in 3 or more bands, speech presence flag, wind noise flag, directional flag.

The above acoustic values are often already calculated because they are used in the signal processor for providing the best output and it does therefore not cause any higher power consumption or the use of more processing power to generate these acoustic values. Further the combination of these values gives a very accurate description of the sound environment. Many other CAV values could be used, but not too many different acoustic values should be used due to storage limitations. Not only acoustic values belonging to the environment are usable hear. Also parameters belonging to the hearing aid could be used, such as the current setting, battery power or other values regarding the hearing aid.

In an embodiment means are provided for storing of CAV's derived from the signal during use of each of the user chosen PPS's during a learning period in the manual mode whereby the means comprises a number of storing places preferably arranged as a second cyclic buffer in a second memory for each of the CAV's for storing consecutively derived values, and storing places in the second memory for storing the most frequently occurring value in the cyclic buffer.

The CAV readings are bound to vary somewhat, even if the sound environment is quite stable and the value, which gets stored for further use, must reflect several readings extending over some time. By using the most frequently occurring value it is assured, that the CAV values which gets stored as a permanent signature for the environment carry the most information about the environment.

However in some cases this is not entirely true, because if the difference between most frequently occurring value and second most frequently occurring value is small, it could indicate that the characterizing value does not carry significant information about the sound environment. Therefore the CAV's are stored along with a weight indicator. The weight indicator shows how much the corresponding stored CAV fluctuates in the cyclic buffer. If the CAV stays unchanged, the weight indicator is high to signify that this CAV is an important factor in the current environment, and if the CAV changes a lot, a low weight indicator gets assigned, to signify that this CAV value is not significant for the current environment.

In an embodiment of the hearing aid system the CAV values to be used in automatic mode and manual mode comprises mean values derived by first storing consecutive acoustic values calculated directly from the input signal of the hearing aid in a first cyclic buffer and storing the most frequently occurring values, such that the most frequently occurring value is the CAV used.

In this way transients, which may occur in the sound environment will not get a dominating influence on the CAV values which are calculated and further used by the hearing aid.

In a further embodiment of the hearing aid system according to the invention, the first cyclic buffer has a first length and update frequency in the manual mode and a second length and update frequency in the automatic mode. In this way this part of the system is shaped dynamically according to the specific task which is performed.

The cyclic buffer makes it possible to see if any of the characterizing values change more permanently to a new constant level, which could form the basis of a new CAV set being written into the memory.

In a further embodiment of the hearing aid system a comparison and a grading means are provided for comparing the current CAV's stored in the first memory in automatic mode with the CAV's belonging to each PPS and stored in the second memory in manual mode and whereby a grade is assigned to each PPS for the correspondence between the current CAV and the CAV belonging to the respective PPS whereby a further cyclic buffer is provided with places for each available PPS and arranged to receive consecutive grades and where the PPS having the highest average grading over the cyclic buffer is used in the signal processing means.

Preferably the comparison between current and stored CAV's is carried out with respect to the weight indicator stored along with the CAV's during the learning phase. If the stored CAV and the current CAV have equal values the weight gets added to a sum, and sums for each PPS are compared and a grading is assigned to each PPS according to the sum. The grades have two values, namely the value 1 for best correspondence between current and stored CAV and 0 for the remaining pairs of stored and current CAV's. This makes the averaging simple, as it is the PPS, which has the highest number of ones, which is being used. The length of the further cyclic buffer is preferably set to 61, but other values are possible. The length-range should be from about 30 up to 200. Larger length will give more precise decision; shorter length will give faster switching. With some intermediate values, e.g., 40, 61, 92, 150, a trade-off between switching-speed and decision-accuracy can be reached. 61 is a good compromise and trials have shown well functioning hearing aids with this value.

According to yet another embodiment of the hearing aid system a further user input means is provided for user determined selection of at least one parameter value belonging to a PPS during use by the signal processing means in the manual or the automatic mode. Hereby it is possible to give the user access to one or more specific parameters of the processing parameter set currently in use. In this way the user may get the possibility to adjust the gain or any other parameter. This is an advantage, as it may occur that the automatically set gain in certain circumstances could lead to uncomfortable sound levels or to too low sound levels.

In an embodiment of the hearing aid system means are provided for comparing the user determined parameter value with the value of the corresponding parameter belonging to the stored PPS. Means are also provided for changing the value of the parameter belonging to the stored PPS in order to reduce the difference between the value of the stored parameter and the value of the user determined parameter. In this way it is ensured that the user preference of e.g. gain setting is stored. When this PPS is later chosen in either automatic or manual mode the user gain is set more accurately according to the user preference.

It is preferred that at least one user determinable parameter value comprises the gain setting. Other parameters could however also be used for this purpose.

BRIEF DESCRIPTION OF THE DRAWINGS

FIG. 5 shows in part the contents of the first cyclic buffer in the first memory in learning mode, FIG. 6 shows in part the contents of the first cyclic buffer in the first memory in automatic mode, FIG. 7 displays the comparison between current environment and the stored environment data of each PPS.

DESCRIPTION OF A PREFERRED EMBODIMENT

Figure 1:
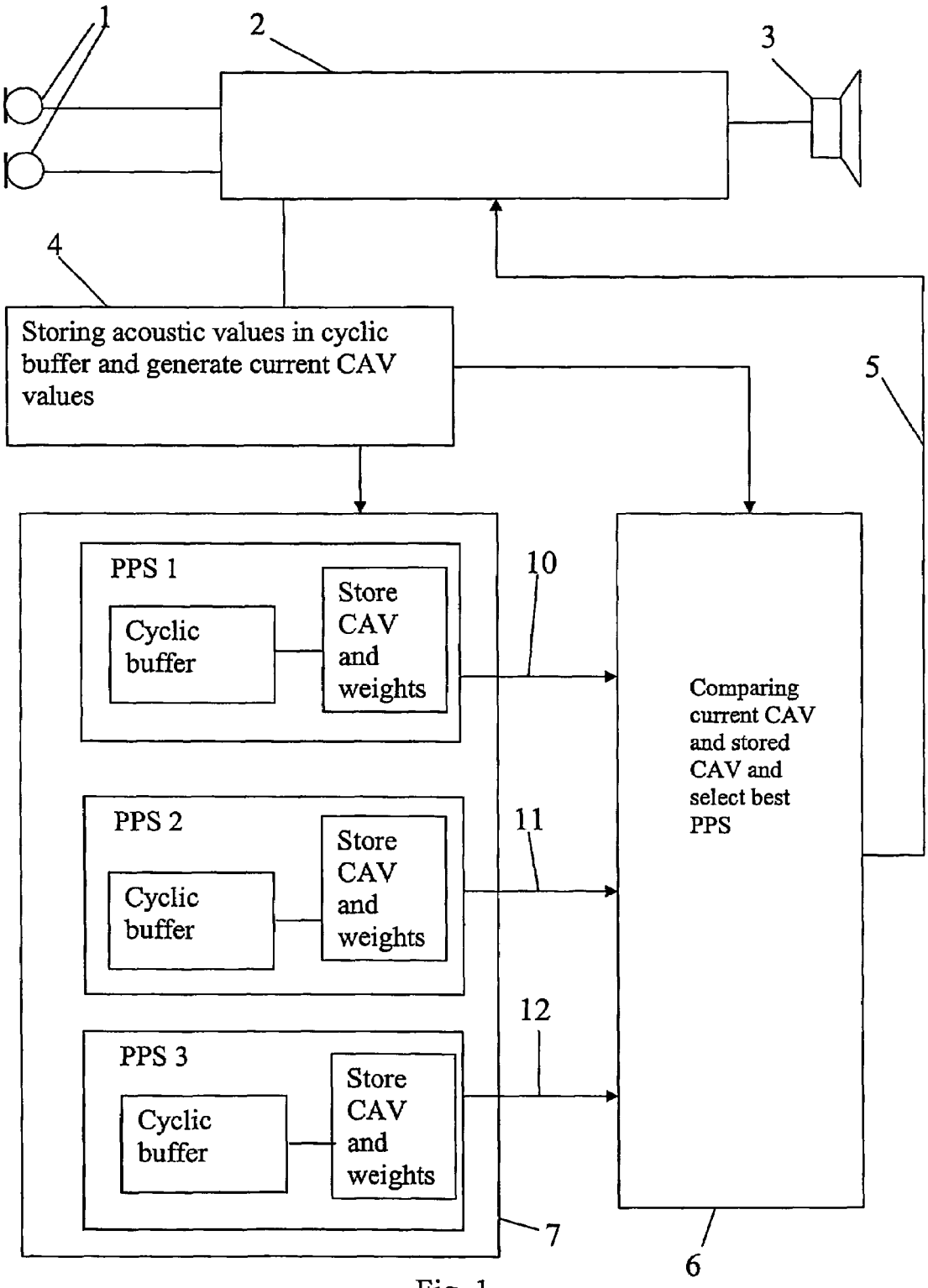
FIG. 1 is an overall diagram of the hearing aid.

The hearing device in FIG. 1 has two microphones 1, a signal processing unit 2, and a receiver 3. The signal processing unit 2 provides an output signal to a receiver 3, which supplies an audio output to the user of the hearing aid. The hearing aid has two different operational modes, namely a manual/learning mode and an automatic mode. In both manual mode and automatic mode acoustic values are calculated from the input signal, stored in a cyclic buffer and from the cyclic buffer an average is extracted and stored for further use. This is illustrated by FIG. 4. The averaging which is proposed according to the current example of the invention is that the most frequently occurring acoustic values gets loaded into the memory for further use, but other averaging schemes could be used. FIGS. 5 and 6 shows an example of the content of the cyclic buffer with the acoustic values representing single point measurements of the acoustic environment. The most frequent occurring value is stored and represents the Characterizing Acoustic Value or CAV which is used in the further calculations. In FIG. 5 the cyclic buffer has a length of 5 and is used in the manual mode, and in FIG. 6 the buffer has a length of 9 and this buffer length is used in automatic mode.

Figure 2:
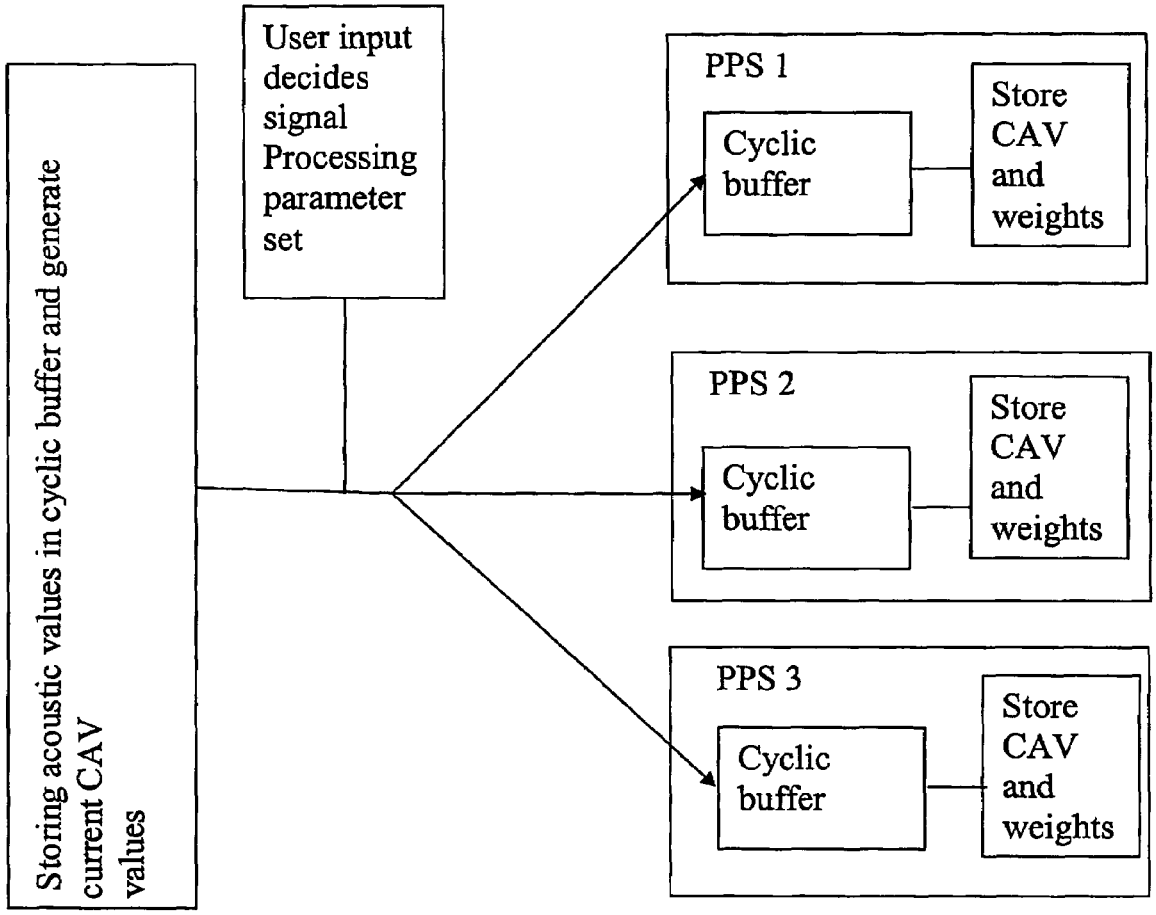
FIG. 2 is a detailed diagram of the aid function in the learning mode.
Figure 3:
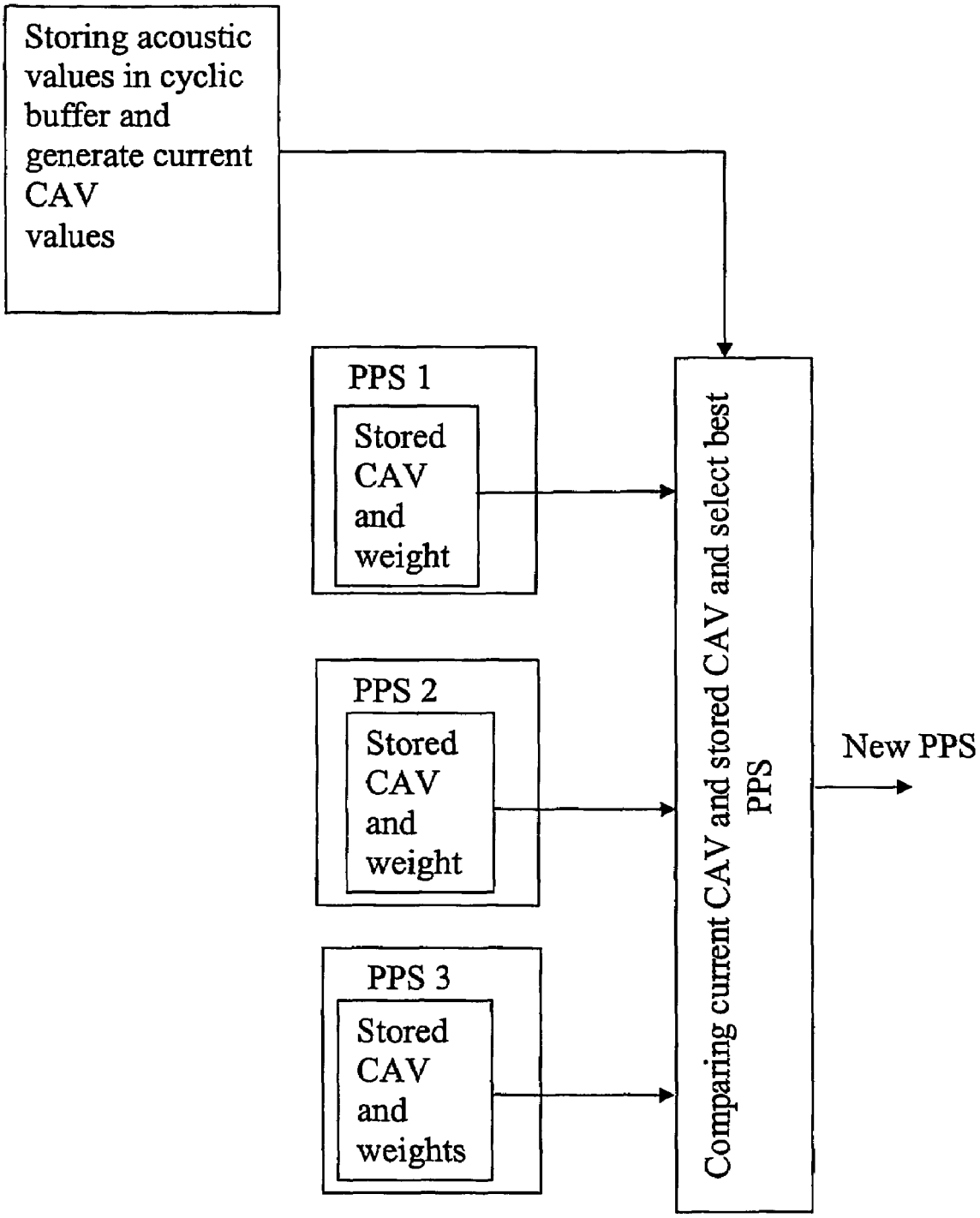
FIG. 3 shows a detailed diagram of the hearing aid function in automatic mode, FIG. 4 displays in part the contents of the second cyclic buffer in the second memory.

In FIG. 2 the utilities for the learning mode is displayed and in FIG. 3 the utilities for the automatic mode is shown. The user decides by activating user input means (not shown) whether learning or automatic mode is used in the hearing aid. Alternatively the hearing aid has a time function which activates the learning mode for a period of time from the date, when the user starts wearing the hearing aid, and then automatically switches to the automatic mode.

In the manual/learning mode the user has to choose the program, also called processing parameter set (PPS), which provides the best signal, whereas in the automatic mode the hearing aid chooses the PPS to be used in the signal processor 2. This automatic choice is based on the current sound environment and the choices made by the user in the learning mode. This is further explained in the following.

In FIG. 2 the learning mode is displayed. In the learning mode the user chooses between a number of predefined PPS or processing parameter sets (PPS 1, PPS 2, PPS 3) in order to get the best signal processing in the current situation. The different processing parameter sets define the working of the hearing aid, which means that the audiometric data of the user are incorporated into each PPS. In FIG. 2 three different PPS possibilities are displayed, but the number of PPS is decided and programmed into the apparatus by the hearing aid acoustician before the hearing aid is handed over to the user. This number and the content of each of the PPS may vary according to the needs of the individual user.

In the described embodiment the acoustic values used can be described using 18 binary places, or 18 different acoustic values are used to describe the environment. The 18 corresponding characterizing acoustic values are taken from the storing places of the first memory 4 (FIG. 5, column 8), and so they each represent the sound environment over some time. FIG. 5 shows how the acoustic values are stored in a buffer (column 2-6) of length 5. The majority value (column 8) of the buffer is used as the current CAV value, which are used in further calculations.

As seen in FIG. 4 the value 0 or 1 of each of the 18 places is loaded into a cyclic buffer according to the chosen PPS. The buffer length is chosen to 16 in the described example, as seen in FIG. 4. For each of the 18 places or CAV values the number of ones is counted and stored. Column 7 in FIG. 4 holds the number of ones. If 8 or more 1's is counted the value 1 is chosen as the best value for describing the sound environment, and if 0-7 ones is counted the value 0 gets stored as the best describing value. If the number of 1's is close to 0 or close to 16 for a given CAV the weight is high, which indicates that this particular CAV is significant. If the number of 1's is close to 8 for a given CAV the weight (column 9) is low or even 0 to indicate that this CAV fluctuates and therefore is not an important parameter in the current environment. The weight indicator is shown in the right column in FIG. 4. This weight indicator could also be a value determined by information theory principles, in order to have biggest weight for most consistent information.

In the beginning the user may have to listen to the hearing aid with each of the PPS possibilities turned on, in order to decide which one is preferable in the current situation. Therefor the capture and storing of environment data or characterizing acoustic values (CAV) is not commenced before some time has lapsed without changes in the choice of PPS. When the hearing aid is handed out to the user default CAVs are stored in the memory. The CAV are consecutively captured and stored according to the user chosen PPS in a second cyclic buffer of a second memory.

In the presented embodiment of the invention the second cyclic buffer in the second memory for storing characterizing acoustic values derived from the input signal has a length of 16. New CAV values get stored in this buffer every 10 seconds. This is shown in FIG. 4 where the contents of the cyclic buffer is shown at a given time.

FIG. 3 displays the working of the hearing aid in the automatic mode. Here current acoustic values are captured and loaded into the first cyclic buffer. The buffer has a length of 9 and new acoustic values are generated and loaded into the buffer every 0.2 seconds. An example of the content at a given time is shown in FIG. 6. The content of the cyclic buffer is used to determine what the current auditory environment is like and this is be done by the use of some kind of averaging function. In the present embodiment of the invention it is preferred to use that buffer value, which occurs most frequently for each of the acoustic values. These most frequent values get stored in a memory as the Characterizing Acoustic Values of the current environment, and can then be compared to the CAV, which have been assigned to each PPS during the learning period as explained above. The CAV values of the memory then reflects the condition of the acoustic environment throughout the past 2 seconds.

The task of comparing current and stored CAV's and choosing the best-suited PPS for the current environment is handled as described in the following with reference to FIG. 7. The current CAV is compared to each of the stored CAV using the weight indicators. If bits are equal, it indicates that the current measured CAV parameter is the same as the CAV parameter found at listening to the corresponding PPS and the corresponding weight gets added to a score assigned to that PPS. In FIG. 7 the summation of the scores is in the bottom-most row. Not all of the CAV values are displayed, but only as examples No. 1-4 and 18 are shown. The PPS with the highest score wins. In the case displayed in FIG. 7 it is PPS 3 which has the highest score. A grade is assigned to each PPS according to how well the current CAV corresponds with the stored CAV. In the present realization of the invention there are two grades, namely one for best match, and zero for all other matches. In the example according to FIG. 7, PPS 1 and 2 gets the grade 0 and PPS 3 gets assigned the grade 1. Consecutive grades get loaded into a cyclic buffer with places for a number of grades for each PPS. That PPS which has the highest number of ones in the cyclic buffer is chosen and used in the on-going signal processing of the hearing aid. The length of this cyclic buffer is chosen to 61. However other lengths are possible.

As seen from the above, the determination of CAV belonging to a particular PPS chosen by the user takes place in two steps: First the acoustic environment values are stored as they are captured, and the most frequently occurring value is used to give CAV values. The CAV values are logged over some time, and the most frequently occurring values are assigned to the particular PPS chosen by the user.

In each PPS a gain is specified, but the user may also be given control of the gain through a further user input possibility. Through this possibility the user may adjust the gain according to his or her preference. Basically this has to be done at every shift of the PPS if the specified gain is not according to the users liking. In order to avoid this the hearing aid according to the invention monitors the users changes of gain, and if the user chooses a gain setting which is higher than the specified gain a new gain setting gets stored in the PPS memory. The new gain is set one dB higher than the originally specified gain. This will happen each time this particular PPS is used and after some time the specified gain will be according to the users liking. If the user at a later time changes his mind and whishes a lower gain, he just chooses to set the gain lower each time the particular PPS is used, and after some time the initial gain setting of this PPS will reach a lower value. This feature of the hearing aid according to the invention is active both in the learning mode and in the automatic mode. In the present example the gain is the parameter, which the user may change, but other parameters may be changeable in this way like the cut-off frequencies or time-constants (attack-, release-times).

The invention claimed is:

1. A hearing device comprising:

a programmable hearing aid having an input transducer and an output transducer with a signal path therebetween, signal processing means connected in said signal path for influencing a signal in the signal path dependent on a PPS or processing parameter set, and a PPS memory accessible by the signal processor means for storing a number of different PPS's for use by the signal processing means, user input means for the user to choose a specific PPS to be used by the signal processing means in manual mode whenever the user experiences a specific acoustic environment, means for capturing and storing in a second memory of CAV's or characterizing acoustic values derived from the signal during use of each of the user chosen PPS during a learning period in the manual mode whereby the means comprises a number of storing places arranged as a second cyclic buffer in the second memory for each of the CAV's for storing consecutively derived values, and storing places in the second memory for storing the most frequently occurring value of each CAV in the cyclic buffer, means for capturing and temporarily storing in a first memory of current CAV in an automatic mode, means for automatic selection of a PPS in an automatic mode, whereby the automatic selection is based on the comparison between current CAV's stored in the first memory and CAV's stored in the second memory.

2. Hearing aid system as claimed in claim 1, whereby the acoustic values used to derive the CAV's comprises one or more of the following:

signal level in 3 or more bands, modulation index in 3 or more bands, speech presence flag, wind noise flag, directional flag.

3. Hearing device as claimed in claim 2, whereby the hearing aid comprises a first cyclic buffer for storing consecutive acoustic values calculated directly from the input signal, and means for selecting and storing the most frequently occurring values in the cyclic buffer as the CAV values.

4. Hearing device as claimed in claim 3, whereby the first cyclic buffer has a first length and update frequency in the manual mode and a second length and update frequency in the automatic mode.

5. Hearing device as claimed in claim 4, whereby a comparison and a grading means is provided for comparing the current CAV's stored in the first memory in the automatic mode with the CAV's belonging to each PPS and stored in the second memory in the manual mode and whereby a grade is assigned to each PPS for the correspondence between the current CAV and the CAV belonging to the respective PPS whereby a further cyclic buffer is provided with places for each PPS and arranged to receive consecutive grades and where the PPS having the highest average grading over the cyclic buffer is used in the signal processing means.

6. Hearing device as claimed in claim 1 having second user input means for user determined selection of at least one parameter value belonging to a PPS during use by the signal processing means in the manual or the automatic mode.

7. Hearing device as claimed in claim 6 where means are provided for comparing the user determined parameter value with the value of the corresponding parameter belonging to the stored PPS and where means are provided for changing the value of the parameter belonging to the stored PPS in order to minimize the difference between the value of the stored parameter and the value of the user determined parameter.

8. Hearing device as claimed in claim 7, wherein the user determined parameter value comprises the gain setting.

9. Method for choosing program in a multi program hearing device, whereby the hearing device has an input transducer and an output transducer with a signal path there between, providing signal processing means connected in said signal path for influencing a signal in the signal path dependent on a PPS or processing parameter set, and providing a PPS memory accessible by the signal processor means and storing a number of different PPS's for use by the signal processing means, providing user input means for the user to choose a specific PPS to be used by the signal processing means whenever the user experiences an acoustic environment, capturing and storing in a second memory of CAV's or characterizing acoustic values derived from the signal during use of each of the user chosen PPS during the learning period in the manual mode are stored in second cyclic buffer in the second memory and where the most frequently occurring value for each of the CAV's is stored in the second memory, capturing and temporarily storing in a first memory of current, CAV's-automatic selection of a PPS, whereby the automatic selection is based on the comparison between current CAV stored in the first memory and CAV's stored in the second memory.

10. Method for choosing a program as claimed in claim 9, whereby the CAVS comprises one or more of the following:

signal level in 3 or more bands, modulation index in 3 or more hands, speech presence flag, wind noise flag, directional flag.

11. Method for choosing a program as claimed in claim 9, whereby the CAV values to be stored in the second cyclic buffer are derived by first storing consecutive acoustic values calculated directly from the input signal of the hearing aid in a first cyclic buffer and storing the most frequently occurring value, such that the most frequently occurring values are used in the CAV values.

12. Method as claimed in claim 11, whereby the first cyclic buffer has a first length and update frequency in manual mode and a second length and update frequency in the automatic mode.

13. Method as claimed in claim 9, whereby the current CAV values which are stored in the first memory in the automatic mode are compared with the CAV values belonging to each PPS and stored in the second memory in the manual mode, and whereby a grade is assigned to each PPS for the correspondence between the current CAV and the CAV belonging to the respective PPS, whereby a further cyclic buffer is provided with places for each PPS and arranged to receive consecutive grades, and where the PPS having the highest average grading over the cyclic buffer is used in the signal processing means.

14. Method as claimed in claim 9, and whereby second user input means are provided for user-determined selection of at least one parameter value belonging to a PPS during use by the signal processing means in the manual or the automatic mode.

15. Method as claimed in claim 14, where the user-determined parameter value is compared with the value of the corresponding parameter belonging to the stored PPS and where the value of the parameter belonging to the stored PPS is changed in order to minimize the difference between the value of the stored parameter and the value of the user-determined parameter.

16. Method as claimed in claim 14, wherein the at least one user-determined parameter value comprises gain setting.

* * * * *